US012235073B2

(12) United States Patent
Sun et al.

(10) Patent No.: US 12,235,073 B2
(45) Date of Patent: Feb. 25, 2025

(54) ADJUSTMENT MECHANISM AND INNER RED DOT SIGHT THEREOF

(71) Applicant: HUANIC CORPORATION, Xi'an (CN)

(72) Inventors: Jianhua Sun, Xi'an (CN); Xuewen Cheng, Xi'an (CN)

(73) Assignee: HUANIC CORPORATION, Xi'an (CN)

( * ) Notice: Subject to any disclaimer, the term of this patent is extended or adjusted under 35 U.S.C. 154(b) by 0 days.

(21) Appl. No.: 18/029,441

(22) PCT Filed: Jul. 30, 2021

(86) PCT No.: PCT/CN2021/109585
§ 371 (c)(1),
(2) Date: Mar. 30, 2023

(87) PCT Pub. No.: WO2022/068365
PCT Pub. Date: Apr. 7, 2022

(65) Prior Publication Data

US 2023/0366656 A1 Nov. 16, 2023

(30) Foreign Application Priority Data

Sep. 30, 2020 (CN) ..... 202011064636.4

(51) Int. Cl.
*F41G 1/30* (2006.01)

(52) U.S. Cl.
CPC ..... *F41G 1/30* (2013.01)

(58) Field of Classification Search
CPC ..... F41G 1/26; F41G 1/28; F41G 1/30
See application file for complete search history.

(56) References Cited

U.S. PATENT DOCUMENTS 7,526,890 B1 * 5/2009 Keng ..... F41G 1/26 42/144
9,733,046 B1 * 8/2017 Bozek ..... F41G 1/17
(Continued)

FOREIGN PATENT DOCUMENTS

CN 2552025 Y 5/2003
CN 103162577 A 6/2013
(Continued)

OTHER PUBLICATIONS

Author unknown, WO2022068365, Mar. 31, 2023, WIPO, English Translation of Written Opinion in PCT/CN2021/109585, All, retrieved here: https://patentscope.wipo.int/search/en/detail.jsf?docId=WO2022068365&_cid=P22-LWHXKL-06223-1 (Year: 2023).*
(Continued)

*Primary Examiner* — Bret Hayes
(74) *Attorney, Agent, or Firm* — CANTOR COLBURN LLP

(57) ABSTRACT

An adjustment mechanism, comprising a left adjustment screw, a stop block threadedly connected to the left adjustment screw, and a right adjustment screw, also comprised are a sliding block a side surface of the front end of which is provided with a transverse sliding groove, a transverse mounting block having an LED chip module mounting base, and a wedge-shaped block; a limiting pin and a spiral reset spring sleeved on the limiting pin are provided at the end part of the right end of the transverse mounting block; the right adjustment screw is threadedly connected to a vertical side surface of the wedge-shaped block, a mounting groove
(Continued)

for mounting the LED chip module mounting base is provided at the top part of the transverse sliding block, and a front end extending surface of the mounting groove communicates with the transverse sliding groove.

5 Claims, 5 Drawing Sheets

(56) References Cited

U.S. PATENT DOCUMENTS

| | | | | |
|---|---|---|---|---|
| 9,869,526 | B1 * | 1/2018 | Cheng | F41G 1/30 |
| 2007/0199227 | A1 * | 8/2007 | Ertl | F41G 1/26 42/137 |
| 2007/0214701 | A1 | 9/2007 | Grauslys et al. | |
| 2008/0092424 | A1 * | 4/2008 | Keng | F41G 1/18 42/137 |
| 2015/0198415 | A1 | 7/2015 | Campean | |
| 2016/0305741 | A1 * | 10/2016 | Jeung | F41G 1/345 |
| 2017/0205194 | A1 * | 7/2017 | Teetzel | F41G 1/26 |
| 2017/0363387 | A1 | 12/2017 | Sun et al. | |
| 2018/0045486 | A1 * | 2/2018 | Jeung | F41G 3/00 |
| 2020/0240748 | A1 | 7/2020 | Connolly | |
| 2022/0034629 | A1 * | 2/2022 | Hamilton | F41G 1/30 |

FOREIGN PATENT DOCUMENTS

| | | | | |
|---|---|---|---|---|
| CN | 104764365 | A | 7/2015 | |
| CN | 206019473 | U | 3/2017 | |
| CN | 107782199 | A | 3/2018 | |
| CN | 107796267 | A | 3/2018 | |
| CN | 109931816 | A | 6/2019 | |
| CN | 110132059 | A | 8/2019 | |
| CN | 110966891 | A | 4/2020 | |
| CN | 112082426 | A | 12/2020 | |
| CN | 212567122 | U | 2/2021 | |
| JP | 2018060171 | A | 4/2018 | |
| WO | 2016112592 | A1 | 7/2016 | |
| WO | WO-2019068165 | A1 * | 4/2019 | F41G 1/30 |

OTHER PUBLICATIONS

International Search Report for corresponding application PCT/CN2021/109585 filed Jul. 30, 2021; Mail date Sep. 27, 2021.

* cited by examiner

ADJUSTMENT MECHANISM AND INNER RED DOT SIGHT THEREOF

CROSS-REFERENCE TO RELATED APPLICATIONS

The present application is a national phase application under 35 U.S.C. 371 of International Application No. PCT/CN2021/109585 filed on Jul. 30, 2021, the entire contents of which are incorporated herein by reference.

TECHNICAL FIELD

The present disclosure relates to the technical field of gun sights, in particular to an adjustment mechanism and a red dot sight thereof.

BACKGROUND

In order to improve shooting accuracy and adapt to different shooting occasions or targets, it is necessary to adjust the emission angle of the LED light source of the inner red dot sight. Generally, a method of cooperating an adjustment screw with a reset spring is employed to implement the adjustment of the pitch angle or the left-and-right angle of the emission angle of the LED light source, especially the independent operation of the upper-and-lower adjustment mechanism. Inevitably, there is mutual influence, to affect the adjustment of the pitch angle when adjusting left and right angles, thereby leading to the low precision and instability and reducing the good user experience. For example, Patent No. 2016209805049, titled "LIGHT SOURCE ADJUSTING MECHANISM FOR INNER-RED-DOT AIMING DEVICE", discloses each of the adjustment of the pitch angle and the adjustment of the left-and-right angle depends on an independently operating mechanism, specifically through a vertical adjustment assembly and a horizontal adjustment assembly, each of which includes an adjustment screw (for example, a vertical adjustment screw and a horizontal adjustment screw) for realizing position adjustment, an adjustment reset spiral spring.

SUMMARY

An object of the present disclosure is to reduce the number of adjustment mechanisms while ensuring the adjustments stability of the LED light source, thereby simplifying the product design structure and reducing the cost, and also facilitating to use.

In order to achieve the above object, the present disclosure provides an adjustment mechanism includes a left adjustment screw, a stop block threadedly connected with the left adjustment screw, and a right adjustment screw. The adjustment mechanism further includes a sliding block provided with a transverse sliding groove at a side surface of a front end of the sliding block, a transverse mounting block having an LED chip module mounting seat mounted at a top portion of a rear end of the mounting sliding block, and a wedge-shaped block. A right end portion of the transverse mounting block is provided with a limiting pin and a spiral reset spring sleeved on the limiting pin.

The transverse mounting block is assembled in the transverse sliding groove, and the spiral reset spring is placed between the limiting pin and a right stopping plate of the transverse sliding groove.

A left end of the transverse mounting block extends out of the transverse sliding groove and abuts against the stop block. A bottom surface of the sliding block is provided with an inclined surface portion sliding relatively parallel to an inclined surface of the wedge-shaped block. The right adjustment screw is threadedly connected with a vertical side surface of the wedge-shaped block to push and pull the wedge-shaped block. Atop portion of the sliding block is provided with a mounting groove for mounting the LED chip module mounting seat, and two spring mounting holes, which are uniformly arranged, are provided on a top surface of the sliding block on either side of the mounting groove, and each of the two mounting holes is configured to assemble a vertical spiral spring resetting upward and downward. An extending surface of the mounting groove at a front end thereof is communicated with the transverse sliding groove.

A first spring ejector pin placed below the LED chip module mounting seat is arranged between a rear side surface of the transverse mounting block and a side wall of the transverse sliding groove, and a first steel ball of the first spring ejector pin abuts against the rear side surface of the transverse mounting block.

Two second spring ejector pins evenly distributed transversely are provided between a bottom surface of the transverse mounting block and a bottom surface of the transverse sliding groove, and a second steel ball of the second spring ejector pin abuts against the bottom surface of the transverse sliding groove.

Also, the present disclosure provides an inner red dot sight with the adjustment mechanism, including a base. A rear end of the base is provided with a mounting cavity of the adjustment mechanism. A rear end of the mounting cavity is provided with an L-shaped fixing seat, and a front end portion of the seat portion of the L-shaped fixing seat is provided with a connecting lug to be threadedly connected with a bottom surface of the base through a screw. The adjustment mechanism is placed on the seat portion.

At least four third spring ejector pins uniformly arranged are provided between a front side surface of a vertical stopping plate portion of the L-shaped fixing seat and a rear side surface of the sliding block, and a third steel ball of the third spring ejector pin abuts against the rear side of the sliding block.

The third spring ejector pin consists of a tubular stopping cap, a steel ball having an outer diameter larger than an inner diameter of a port at one end of the tubular stopping cap and placed inside the port, and a spiral spring having one end abutting against the steel ball and the other end extending out of the other end of the tubular stopping cap. A part of the steel ball extends beyond the tubular stopping cap.

Each of an eyepiece and an objective lens of the inner red dot sight is provided with a protective cover assembly including a window frame element with a protective glass, one end of the window frame element is provided with two connecting hole elements opposite to each other, the vertical portion of a T-shaped connector is placed between the two connecting hole elements, a perforation in the vertical portion and a perforation in the connecting hole element are coaxial with each other and have the same pore diameter, and a connecting rotating shaft penetrates into the perforations on the connecting hole element and the vertical portion. A torsion spring is provided at either end of the connecting rotating shaft, so that the window frame element rotates to a direction away from the eyepiece or the objective lens relative to the vertical portion.

The straight portion of the T-shaped connector is provided with a screw hole at a position placed below the connecting hole element.

The present disclosure has the advantages as follows: the adjustment mechanisms for the pitch angle and the left-and-right position are assembled with each other, and a fine adjustment of the pitch angle and the left-and-right angle of the light emission angle of the LED chip can be realized simultaneously only through the reserved horizontal adjustment mechanism by means of the translation of the wedge-shaped block and simultaneously moving upward or downward, the adjustment mechanism of the product can be simplified, the production cost can be reduced, and it is convenient to use.

The present disclosure will be described in detail with the accompanying drawings and embodiments.

LIST OF REFERENCE NUMBERS

1 Left Adjustment Screw
2 Stop Block
3 Right Adjustment Screw
4 Transverse Sliding Groove
5 Sliding Block
6 LED Chip Module Mounting Seat
7 Transverse Mounting Block
8 Wedge-shaped Block
9 Limiting Pin
10 Spiral Reset Spring
11 Right Stopping Plate
12 Spring Mounting Hole
13 Vertical Spiral Spring
14 First Spring Ejector Pin
15 Second Spring Ejector Pin
16 Inclined Surface
17 Mounting Groove
18 Base
19 Mounting Cavity
20 L-shaped Fixing Seat
21 Seat Portion
22 Connecting Lug
23 Vertical Stopping Plate
24 Third Spring Ejector Pin
25 Tubular Stopping Cap
26 Steel Ball
27 Spiral Spring
28 Protective Glass
29 Window Frame Element
30 Connecting Hole Element
31 Vertical Portion
32 Connecting Rotating Shaft
33 Torsion Spring
34 Straight Portion
35 Screw Hole
36 Buckle
37 Screw

DETAILED DESCRIPTION

Figure 1:
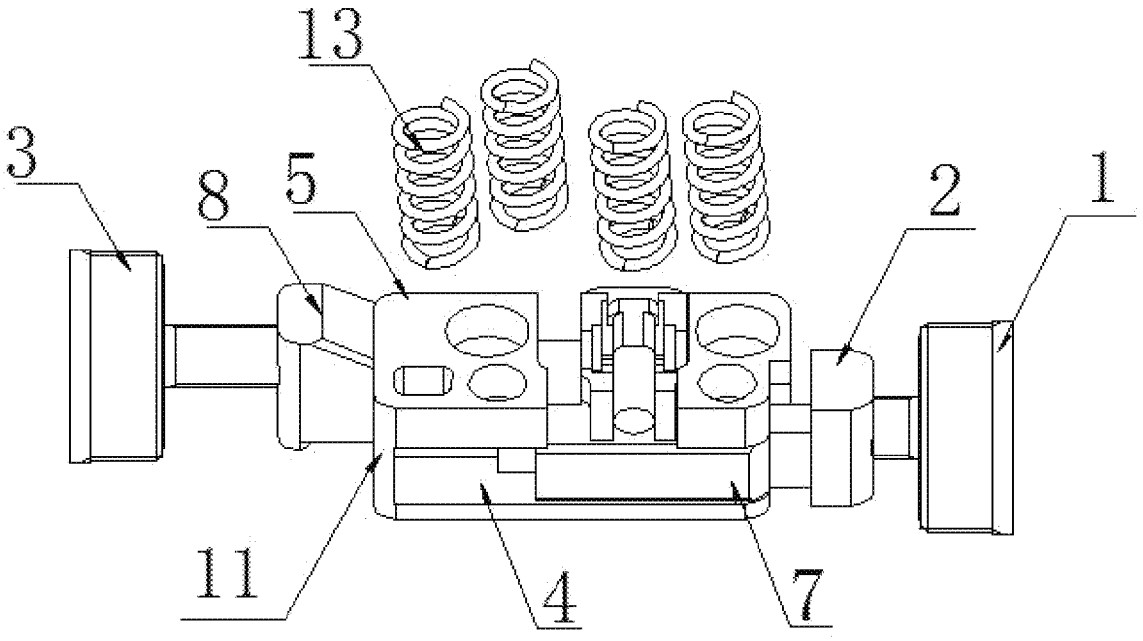
FIG. 1 is a schematic structural view of an adjustment mechanism.
Figure 2:
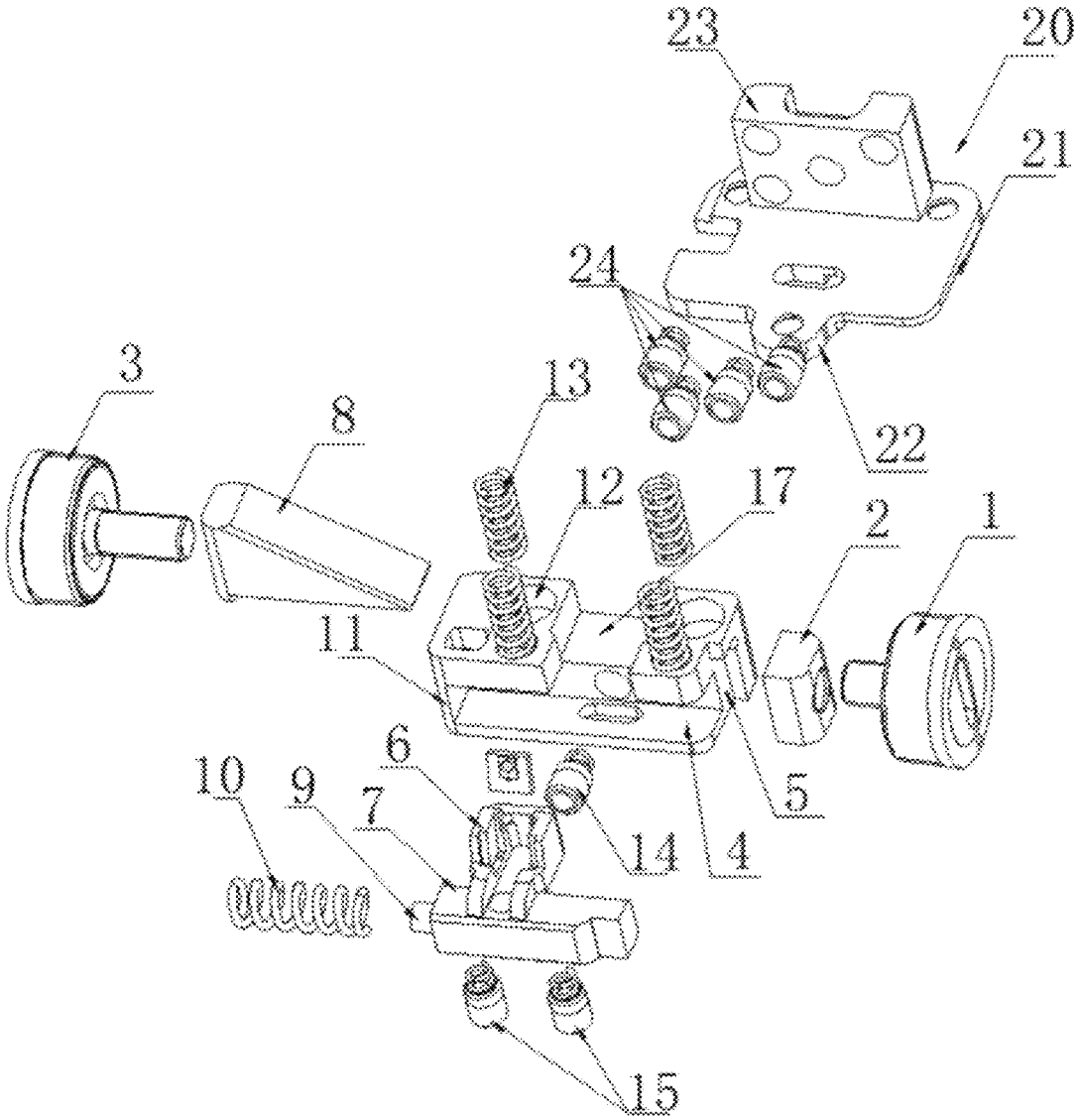
FIG. 2 is a disassembled schematic view of the adjustment mechanism.

In order to ensure adjustment stability of a LED light source, reduce the number of adjustment mechanisms, simplify the product design structure, reduce the cost, and facilitate for users to use, this embodiment provides an adjustment mechanism as shown in FIGS. 1 and 2. The adjustment mechanism includes a left adjustment screw 1, a stop block 2 threadedly connected with the left adjustment screw 1, and a right adjustment screw 3. The adjustment mechanism further includes a sliding block 5 provided with a transverse sliding groove 4 at a side surface of a front end thereof, a transverse mounting block 7 having an LED chip module mounting seat 6 mounted at a top portion of a rear end thereof, and a wedge-shaped block 8. A right end portion of the transverse mounting block 7 is provided with a limiting pin 9 and a spiral reset spring 10 sleeved on the limiting pin 9. The transverse mounting block 7 is assembled in the transverse sliding groove 4, and the spiral reset spring 10 is placed between the limiting pin 9 and a right stopping plate 11 of the transverse sliding groove 4 (i.e., a stopping plate at a right end of the transverse sliding block). A left end of the transverse mounting block 7 extends out of the transverse sliding groove 4 and abuts against the stop block 2. A bottom surface of the sliding block 5 is provided with an inclined surface portion 16 which may slide relatively parallel to an inclined surface of the wedge-shaped block 8 as shown in FIG. 3, so that the transverse sliding block may move upward or downward when the wedge-shaped block 8 moves leftward and rightward, in this way, a LED chip module mounting seat 6 placed on a top surface of the sliding block 5 moves rightward and upward, or moves leftward and downward (based on a direction as shown in FIG. 2, that is, "leftward" refers to a direction towards a left hand side in FIG. 2 from an observer, and "upward" refers to a direction towards the top in FIG. 2), so that the LED chip can be adjusted rightward and upward or leftward and downward slightly, and the fine adjustment of the pitch angle and left-and-right angle of the emission light of the LED chip can be completed synchronously.

The right adjustment screw 3 is threadedly connected with a vertical side surface of the wedge-shaped block 8 to push and pull the wedge-shaped block 8. That is, the right adjustment screw 3 is generally fixedly mounted on a housing of the inner red dot sight, and when the right adjustment screw 3 rotates clockwise and counterclockwise, the wedge-shaped block 8 may be pushed or pulled leftward or rightward. This is a basic principle of turbo-worm.

Figure 3:
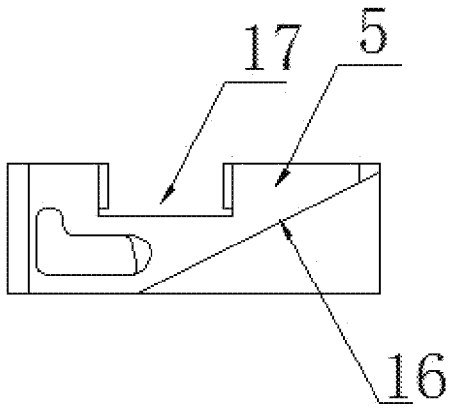
FIG. 3 is a schematic view of cooperation between a sliding block and a wedge-shaped block.

In order to realize the fine synchronous adjustment of the pitch angle and the left-and-right angle of the emission light of the LED chip (LED lamp), in this embodiment, a mounting groove 17 for mounting the LED chip module mounting seat 6 as shown in FIGS. 2 and 3 is arranged at the top portion of the sliding block 5, and two spring mounting holes 12 which are uniformly arranged are provided on a top surface of the sliding block 5 on each of two sides of the mounting groove 17, and each of the spring mounting holes 12 is configured to assemble a vertical spiral spring 13 which may be reset upward and downward. It can be seen from FIG. 2 that an extending surface of the mounting groove 17 at its front end is communicated with the transverse sliding groove 4, so that the LED chip module mounting seat 6 can be mounted in the mounting groove 17 while the sliding block 5 is assembled in the transverse sliding groove 4, so that the fine synchronous adjustment of the up-and-down (i.e., vertical) position and the left-and-right (i.e., horizontal) position of the LED lamp can be achieved only by the left adjustment screw 1, the stop block 2, the spiral reset spring 10, the right adjustment screw 3, the wedge-shaped block 8 and the vertical spiral spring 13. Mainly due to the cooperation of the wedge-shaped block 8 and the inclined surface of the inclined surface portion 16, the up-and-down position adjustment can be completed under the cooperation of the vertical spiral spring 13 as moving horizontally.

In order to eliminate an adjustment gap and ensure stability of the adjustment process, in this embodiment, a first spring ejector pin 14 placed below the LED chip module mounting seat 6 is arranged between a rear side surface of the transverse mounting block 7 and a side wall of the transverse sliding groove 4, and a first steel ball of the first spring ejector pin 14 abuts against the rear side surface of the transverse mounting block 7. At the same time, two second spring ejector pins 15, which are uniformly distributed transversely, are provided between a bottom surface of the transverse mounting block 7 and a bottom surface of the transverse sliding groove 4, and a second steel ball of the second spring ejector pin 15 abuts against the bottom surface of the transverse sliding groove 4.

Figure 5:
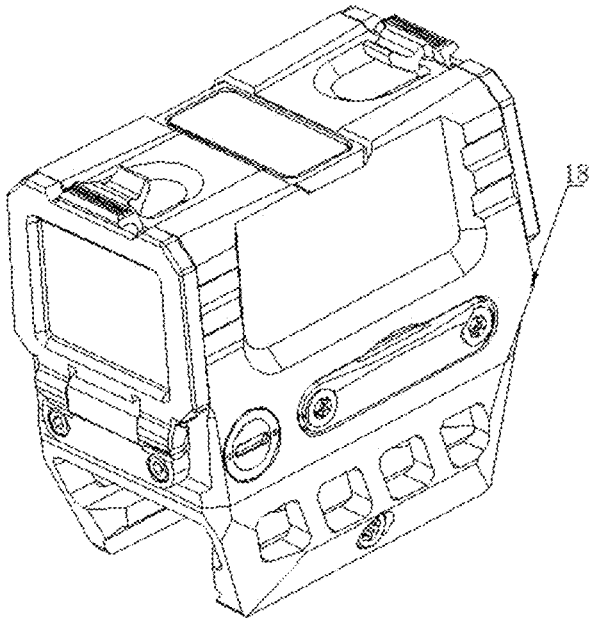
FIG. 5 is a perspective view of an inner red dot sight.
Figure 6:
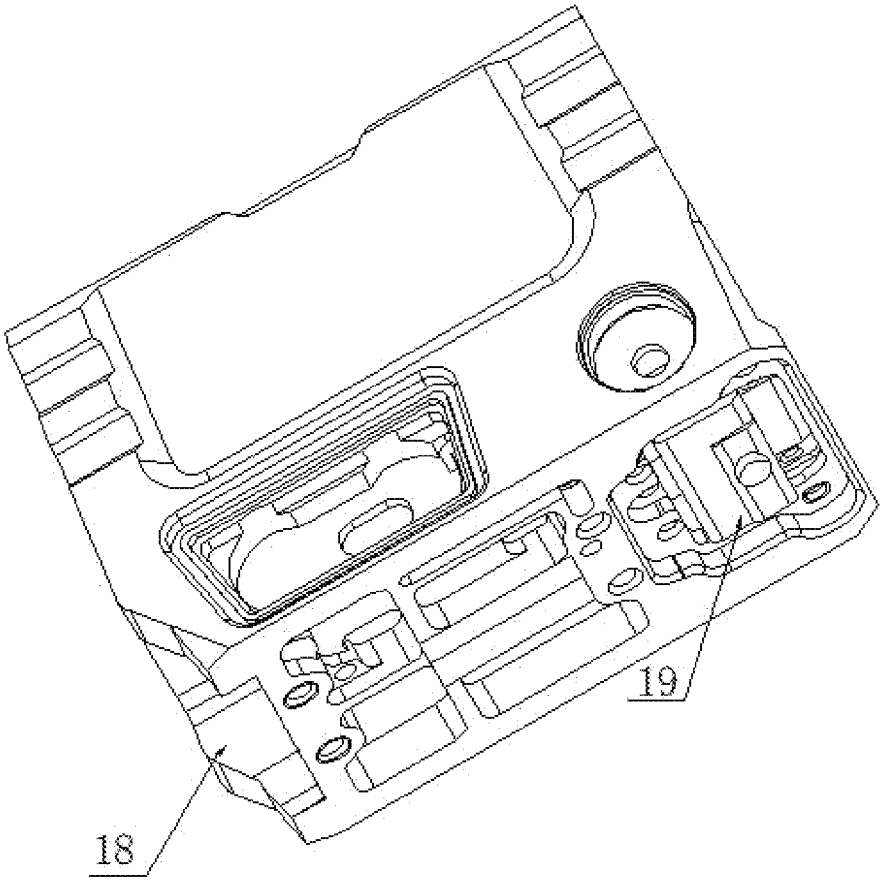
FIG. 6 is a transverse sectional view of a rear end of a base of the inner red dot sight as shown in FIG. 5.
Figure 7:
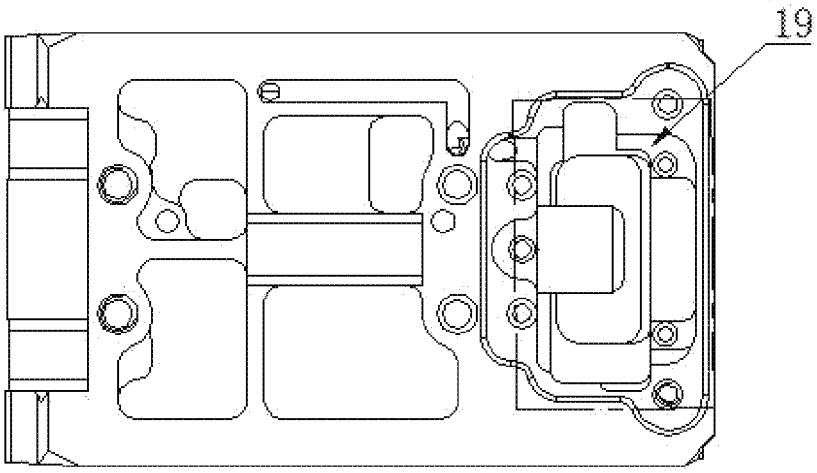
FIG. 7 is a bottom view of the base of the inner red dot sight as shown in FIG. 5 (without a mounting cavity protective plate).

FIGS. 5, 6 and 7 show an inner red dot sight with the aforementioned adjustment mechanism, which includes a base 18. A rear end of the base 18 is provided with a mounting cavity 19 of the adjustment mechanism. A rear end of the mounting cavity 19 is provided with an L-shaped fixing seat 20 as shown in FIG. 2, and a front end portion of the seat portion 21 of the L-shaped fixing seat 20 is provided with a connecting lug 22 to be threadedly connected with a bottom surface of the base 18 through screw(s). The adjustment mechanism is placed on the seat portion 21. At least four third spring ejector pins 24, which are uniformly arranged, are provided between a front side surface of a vertical stopping plate portion 23 of the L-shaped fixing seat 20 and a rear side surface of the sliding block 5, and a third steel ball of the third spring ejector pin 24 abuts against the rear side surface of the sliding block 5.

Figure 4:
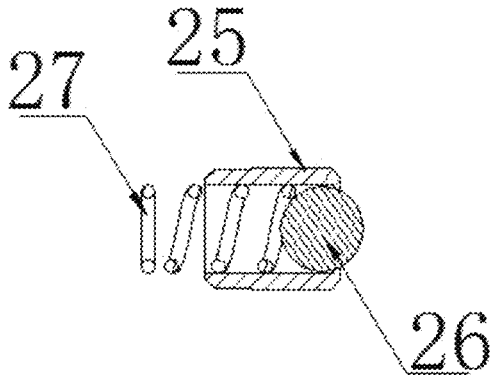
FIG. 4 is a longitudinal sectional view of a first spring ejector pin or a second spring ejector pin or a third spring ejector pin.

FIG. 4 shows a structural sectional view of the first spring ejector pin 14, the second spring ejector pin 15 and the third spring ejector pin 24, each of which consists of a tubular stopping cap 25, a steel ball 26 having an outer diameter larger than an inner diameter of a port at one end of the tubular stopping cap 25 and placed inside the port, and a spiral spring 27 having one end abutting against the steel ball 26 and the other end extending out of the other end of the tubular stopping cap 25. A part of the steel ball 26 may extend beyond the tubular stopping cap 25.

As above described, in this present disclosure, the transverse mounting block 7 provided with a LED lamp is assembled in the sliding block 5, and the LED chip module mounting seat 6 integrally connected with the top portion of the rear end of the transverse mounting block 7 is assembled in the mounting groove 17 at the top portion of the sliding block 5, so that the synchronous fine adjustment of the up-and-down position and the left-and-right position of the LED lamp can be realized under the cooperation of the left adjustment screw 1, the stop block 2, the spiral reset spring 10, the right adjustment screw 3, the wedge-shaped block 8 and the vertical spiral spring 13, and the first spring ejector pin 14, the second spring ejector pin 15 and the third spring ejector pin 24 are provided to minimize or even eliminate the adjustment gap, ensure the stability of adjustment, and the structure becomes compact to reduce a volume of the inner red dot sight.

Figure 8:
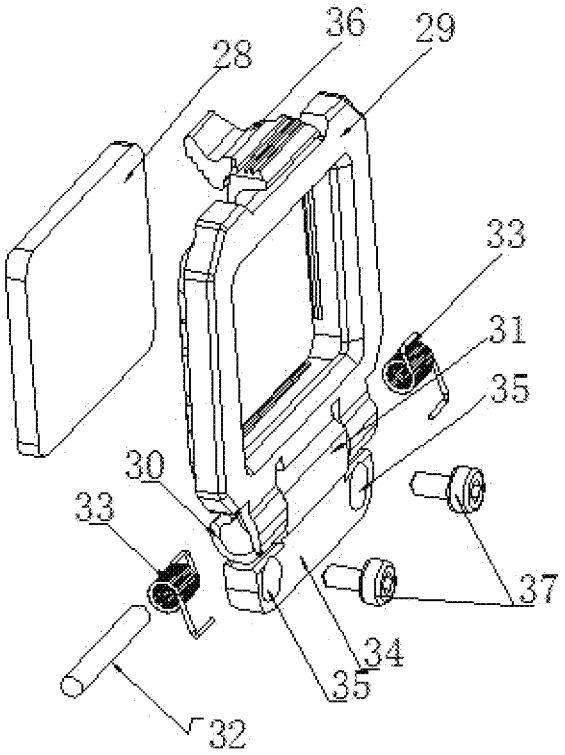
FIG. 8 is a disassembled schematic view of a protective cover assembly.
Figure 9:
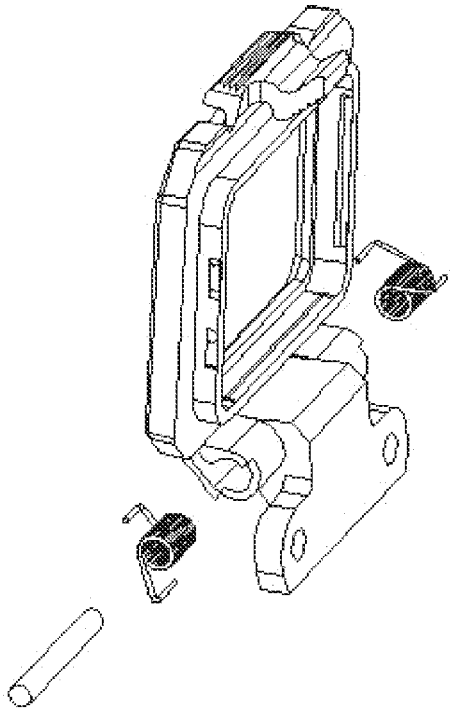
FIG. 9 is a schematic view of an inner structure of the protective cover assembly.

In order to opening the protective cover for protecting an eyepiece or an objective lens quickly, each of the eyepiece and the objective lens of the inner red dot sight provided by this embodiment is provided with a protective cover assembly as shown in FIGS. 8 and 9. The protective cover assembly includes a window frame element 29 with a protective glass 28, a lower end of the window frame element 29 is provided with two connecting hole elements 30 opposite to each other. The vertical portion 31 of a T-shaped connector is placed between the two connecting hole elements 30, a perforation in the vertical portion 31 and a perforation in the connecting hole element 30 are coaxial with each other and have the same pore diameter, and a connecting rotating shaft 32 penetrates into the perforations on the connecting hole element 30 and the vertical portion 31. A torsion spring 33 is provided on either end of the connecting rotating shaft 32, and the window frame element 29 rotates to a direction away from the eyepiece or the objective lens relative to the vertical portion 31, so that after a buckle 36 arranged at the top portion of the window frame element 29 is manually unlocked, the window frame element 29 in the protective cover assembly rotates together with the protective glass 28 downward outside the eyepiece and the objective lens, so that the eyepiece and the objective lens are exposed outside and may be used conveniently. A straight portion 34 of the T-shaped connector is provided with a screw hole 35 at a position thereof placed below the connecting hole element 30, and is fixed on the housing of the inner red dot sight below the eyepiece and the objective lens by screws 37, so as to support and connect with the window frame element 29.

What is claimed is:

1. An adjustment mechanism comprising a left adjustment screw, a stop block threadedly connected with the left adjustment screw, and a right adjustment screw, wherein the adjustment mechanism further comprises a sliding block provided with a transverse sliding groove at a side surface of a front end of the sliding block, a transverse mounting block having an LED chip module mounting seat mounted at a top portion of a rear end of the transverse mounting block, and a wedge-shaped block;

a right end portion of the transverse mounting block is provided with a limiting pin and a spiral reset spring sleeved on the limiting pin;

the transverse mounting block is assembled in the transverse sliding groove, and the spiral reset spring is placed between the limiting pin and a right stopping plate of the transverse sliding groove;

a left end of the transverse mounting block extends out of the transverse sliding groove and abuts against the stop block;

a bottom surface of the sliding block is provided with an inclined surface portion configured to slide relatively parallel to an inclined surface of the wedge-shaped block;

the right adjustment screw is threadedly connected with a vertical side surface of the wedge-shaped block to push and pull the wedge-shaped block;

a top portion of the sliding block is provided with a mounting groove for mounting the LED chip module mounting seat, and a top surface of the sliding block on either side of the mounting groove is provided with two spring mounting holes which are uniformly arranged and into which vertical spiral springs are assembled respectively;

an extending surface of the mounting groove at a front end thereof is in communication with the transverse sliding groove;

a first spring ejector pin placed below the LED chip module mounting seat is arranged between a rear side surface of the transverse mounting block and a side wall of the transverse sliding groove, and a first steel ball of the first spring ejector pin abuts against the rear side surface of the transverse mounting block;

two second spring ejector pins evenly distributed transversely are provided between a bottom surface of the transverse mounting block and a bottom surface of the transverse sliding groove, and a second steel ball of each of the second spring ejector pins abuts against the bottom surface of the transverse sliding groove.

2. An inner red dot sight having the adjustment mechanism according to claim 1, comprising a base, wherein a rear end of the base is provided with a mounting cavity of the adjustment mechanism; a rear end of the mounting cavity is provided with an L-shaped fixing seat, and a front end portion of the seat portion of the L-shaped fixing seat is provided with a connecting lug to be threadedly connected with a bottom surface of the base through a screw;

the adjustment mechanism is disposed on the seat portion;

at least four third spring ejector pins uniformly arranged are provided between a front side surface of a vertical stopping plate portion of the L-shaped fixing seat and a rear side surface of the sliding block, and a third steel ball of each of the third spring ejector pins abuts against the rear side of the sliding block.

3. The inner red dot sight according to claim 2, wherein each of the third spring ejector pins consists of a tubular stopping cap, a steel ball having an outer diameter larger than an inner diameter of a port at one end of the tubular stopping cap and placed inside the port, and a spiral spring having one end abutting against the steel ball and the other end extending out of the other end of the tubular stopping cap;

a part of the steel ball extends beyond the tubular stopping cap.

4. The inner red dot sight according to claim 3, wherein the inner red dot sight is provided with a protective cover assemblies for covering and protecting each of an eyepiece and an objective lens of the inner red dot sight and each of the protective cover assemblies comprises a window frame element with a protective glass, one end of the window frame element is provided with two connecting hole elements opposite to each other, a vertical portion of a T-shaped connector is disposed between the two connecting hole elements, a perforation in the vertical portion and a perforation in the connecting hole element are coaxial with each other and have the same pore diameter, and a connecting rotating shaft penetrates into the perforations on the connecting hole element and the vertical portion; and a torsion spring is provided at either end of the connecting rotating shaft, so that the window frame element rotates to a direction away from the eyepiece or the objective lens relative to the vertical portion;

the straight portion of the T-shaped connector is provided with a screw hole at a position placed below the connecting hole element.

5. The inner red dot sight according to claim 2, wherein the inner red dot sight is provided with a protective cover assemblies for covering and protecting each of an eyepiece and an objective lens of the inner red dot sight and each of the protective cover assemblies comprises a window frame element with a protective glass, one end of the window frame element is provided with two connecting hole elements opposite to each other, a vertical portion of a T-shaped connector is disposed between the two connecting hole elements, a perforation in the vertical portion and a perforation in the connecting hole element are coaxial with each other and have the same pore diameter, and a connecting rotating shaft penetrates into the perforations on the connecting hole element and the vertical portion; and a torsion spring is provided at either end of the connecting rotating shaft, so that the window frame element rotates to a direction away from the eyepiece or the objective lens relative to the vertical portion;

the straight portion of the T-shaped connector is provided with a screw hole at a position placed below the connecting hole element.

* * * * *